US006963654B2

(12) United States Patent
Sotme et al.

(10) Patent No.: US 6,963,654 B2
(45) Date of Patent: Nov. 8, 2005

(54) DIAPHRAGM, FLAT-TYPE ACOUSTIC TRANSDUCER, AND FLAT-TYPE DIAPHRAGM

(75) Inventors: Hiromi Sotme, Tokyo (JP); Toshiiku Miyazaki, Tokyo (JP)

(73) Assignee: FPS Inc., Tokyo (JP)

( * ) Notice: Subject to any disclaimer, the term of this patent is extended or adjusted under 35 U.S.C. 154(b) by 84 days.

(21) Appl. No.: 10/261,079

(22) Filed: Sep. 27, 2002

(65) Prior Publication Data

US 2003/0068054 A1 Apr. 10, 2003

(30) Foreign Application Priority Data

Oct. 4, 2001 (JP) ..... 2001-308188
Jun. 13, 2002 (JP) ..... 2002-172521

(51) Int. Cl.[7] ..... H04R 1/00
(52) U.S. Cl. ..... 381/431; 381/399
(58) Field of Search ..... 181/171, 172, 181/173; 381/152, 171, 173, 186, 191, 399, 381/401, 408, 421, 423, 431

(56) References Cited

U.S. PATENT DOCUMENTS 4,337,379 A * 6/1982 Nakaya ..... 381/408
4,471,173 A * 9/1984 Winey ..... 381/408
4,480,155 A * 10/1984 Winey ..... 381/408
5,297,214 A * 3/1994 Bruney ..... 381/431
6,480,614 B1 11/2002 Denda et al.

FOREIGN PATENT DOCUMENTS

JP 3159714 4/2001
WO WO-99/03304 1/1999

* cited by examiner

*Primary Examiner*—Sinh Tran
*Assistant Examiner*—Brian Ensey
(74) *Attorney, Agent, or Firm*—Taiyo, Nakajima & Kato

(57) ABSTRACT

A first conductor and a second conductor are provided at a diaphragm. The first and second conductors intersect magnetic force lines between north poles and south poles of permanent magnets M which are adjacent to one another. When electricity passes through the conductors, a direction in which a force from the magnetic field acts on the current is substantially orthogonal to a surface of the diaphragm. Therefore, the diaphragm can be oscillated in the direction orthogonal to the diaphragm surface. The conductors have widths of from 1000 μm to 2000 μm. Therefore, relative errors in the widths caused by etching can be greatly reduced compared to the prior art, and etching is easier. Moreover, the conductors are arranged in a zigzag pattern. Because the conductors do not have a coil form, a large number of through-holes is not required as in conventional products.

16 Claims, 15 Drawing Sheets

DIAPHRAGM, FLAT-TYPE ACOUSTIC TRANSDUCER, AND FLAT-TYPE DIAPHRAGM

BACKGROUND OF THE INVENTION

1. Field of the Invention

The present invention relates to a diaphragm for a flat-type acoustic transducer, which is to be used in a flat-type acoustic transducer such as a flat-type speaker, a flat-type microphone, a flat-type speaker that is usable as a microphone, or the like, and relates to a flat-type acoustic transducer that uses this diaphragm for a flat-type acoustic transducer.

2. Description of the Related Art

Examples of flat-type acoustic transducers include a dynamic flat-type speaker disclosed in Japanese Patent No. 3,159,714.

In this flat-type speaker, a plurality of permanent magnets are disposed neighboring each other and separated by a predetermined spacing such that polarities thereof intersectingly oppose one another. A diaphragm is provided facing the permanent magnets and disposed at a predetermined separation therefrom.

Coils are formed at the diaphragm in correspondence to the respective permanent magnets. The coils are formed in a coil shape.

When electric current is passed through the coils, a force acts in a direction orthogonal to a membrane surface of the diaphragm. The diaphragm is displaced in the direction orthogonal to the membrane surface.

Consequently, by passing electrical signals representing sounds that are desired to be emitted through the coils, the diaphragm is caused to oscillate in accordance with the electrical signals, and acoustic signals are emitted.

In the dynamic flat-type Speaker disclosed in Japanese Patent No. 3,159,714 and in other conventional dynamic flat-type speakers, because the conductors are formed as coils formed in coil shapes, a width of each conductor is extremely narrow.

Further, in these flat speakers, permanent magnets are provided for each of the conductors formed in coil shapes.

Such conductors may be formed by laminating, vapor-depositing, adhering or the like a metallic film of copper, aluminium or the like onto a diaphragm fabricated of synthetic resin. This metallic film can then be structured by etching.

In a case where the plurality of coil-shaped coils is arranged at only one side of the diaphragm, and this plurality of coil-shaped coils is connected in series, in order to connect an end portion of an inner side of one coil with an end portion of an outer side of another coil, it is necessary to dispose conductive wiring for connection at a side of the diaphragm opposite to the side thereof at which the coils are formed, and it is necessary to connect the coils with this conductive wiring for connection, via through-holes.

When a plurality of coil-shaped coils are connected in series, through-holes are necessary for all the coils (for all the magnets), and a plurality of the through-holes is formed in the diaphragm. Consequently, when a connection failure at a through-hole portion occurs, an examination for investigating at which portion the connection failure has occurred is complex. Thus, there is a problem in that dealing with cases in which connection faults have occurred is complex.

Furthermore, even if the coil-shaped coils are disposed at both sides of the diaphragm, the coils at a front surface side and the coils at a rear surface side have to be connected via through-holes, and the same problem arises.

Therefore, there is a problem in that fabrication of diaphragms for flat-type speakers is more difficult than for usual printed boards and the like.

SUMMARY OF THE INVENTION

The present invention has been devised in order to solve the above-described problems of the prior art, and an object of the present invention is to provide a diaphragm which is easier to fabricate, and a flat-type acoustic transducer.

A first aspect of the present invention is a diaphragm for use in a flat-type acoustic transducer having a plurality of magnets extending in a first direction and in a second direction intersecting the first direction with adjacent magnets having mutually different magnetic polarities, the diaphragm comprising: a flat-form diaphragm main body mountable facing the magnets; and a conductor provided at the diaphragm main body intersecting a magnetic field formed between north poles and south poles of adjacent magnets, and the conductor being disposed around a circumference of each magnet by less than 360°.

Next, operation of the diaphragm for a flat-type acoustic transducer of the first aspect is described.

The diaphragm for a flat-type acoustic transducer of the first aspect is disposed for use with a predetermined separation from the plurality of magnets. A plurality of magnets extending in a first direction and in a second direction intersecting the first direction with adjacent magnets having mutually different magnetic polarities.

According to this diaphragm for a flat-type acoustic transducer, the conductor is provided extending in a direction which intersects magnetic force lines between mutually adjacent north poles and south poles. Consequently, when current is passed through the conductor, a direction in which the magnetic field acts on the current is substantially orthogonal to the diaphragm surface. Accordingly, the diaphragm for the flat-type acoustic transducer can be caused to oscillate in the direction orthogonal to the surface of the diaphragm main body.

Further, the conductor is provided so as to encircle each magnet by less than 360°. Moreover, the conductor is not coil-shaped. That is, the conductor does not include pluralities of winding turns, known as coil-form portions. Therefore, a large number of through-holes does not need to be provided as in the prior art, and the structure is simple.

A second aspect of the present invention is the diaphragm for a flat-type acoustic transducer according to the first aspect, wherein the magnets are arranged in at least one of a row along the first direction and the second direction, and the conductor comprises a zigzag portion which extends in a zigzag fashion along the row.

Next, operation of the diaphragm for a flat-type acoustic transducer of the second aspect is described.

According to the diaphragm for a flat-type acoustic transducer of the second aspect, the conductor is disposed in a zigzag shape along the row of magnets. Therefore, a conductor pattern has a simple shape, and design and disposition of the pattern are easy.

A third aspect of the present invention is the diaphragm for a flat-type acoustic transducer according to the first aspect or the second aspect, wherein a plurality of the conductors are provided, with each conductor being insulated and arranged parallel and proximate one another in a width direction thereof.

Next, operation of the diaphragm for a flat-type acoustic transducer of the third aspect is described.

According to the diaphragm for a flat-type acoustic transducer of the third aspect, a plurality of the conductors are disposed adjacent to one another in the width direction of the conductors, and substantially parallel to one another. The respective conductors are electrically insulated from one another.

The plurality of conductors may be connected to an amplifier, which outputs electrical signals, in series and/or in parallel. Thus, the impedance of the flat-type acoustic transducer can be easily altered by changing the manner in which the plurality of conductors are connected.

A fourth aspect of the present invention is the diaphragm for a flat-type acoustic transducer according to one of the first, second and third aspects, wherein the conductor includes a width of at least 1000 $\mu$m.

Next, operation of the diaphragm for a flat-type acoustic transducer of the fourth aspect is described.

According to the diaphragm for a flat-type acoustic transducer of the fourth aspect, the conductor has a width of at least 1000 $\mu$m. Therefore, proportional errors of width caused by etching can be made even smaller.

A fifth aspect of the present invention is the diaphragm for a flat-type acoustic transducer according to the fourth aspect, wherein the conductor includes a section at which the conductor is divided into a plurality of parallel conductor portions.

Next, operation of the diaphragm for a flat-type acoustic transducer of the fourth aspect is described.

Because the width of the conductor is large, there may be cases in which eddy currents are generated, particularly when high frequency currents are passed therethrough. Accordingly, the occurrence of eddy currents can be suppressed by partially dividing the conductor into a plurality of parallel portions.

A sixth aspect of the present invention is the diaphragm for a flat-type acoustic transducer according to one of the first to fifth aspects, wherein the conductor is provided at both faces of the diaphragm main body.

Next, operation of the diaphragm for a flat-type acoustic transducer of the sixth aspect is described.

According to the diaphragm for a flat-type acoustic transducer of the sixth aspect, the conductors are provided at both sides of the diaphragm main body. Therefore, driving forces on the diaphragm main body can be substantially doubled compared to a case in which a conductor is provided at one side of the diaphragm main body. Consequently, the efficiency of the flat-type acoustic transducer can be improved.

Further, in a case in which the conductor is provided at only one side of the diaphragm main body, for example, in which the zigzag shape conductor is disposed at a plurality of magnets which form a line, there are discontinuous portions at which the conductor is not disposed at outer peripheral portions of the magnets. Thus, driving forces will operate on the diaphragm inconsistently.

Inconsistency of the driving forces is obviously undesirable, particularly in cases where there are only a few rows of magnets (for example, two rows).

In the present case, the conductors are provided at both sides of the diaphragm main body. By adjusting the relative positions of the zigzag-shaped conductors, the conductors can be made to completely encircle outer circumference portions of the magnets. Thus, driving forces can be made to operate consistently over the diaphragm.

A seventh aspect of the present invention is a flat-type acoustic transducer including: the diaphragm for a flat-type acoustic transducer according to one of the first to sixth aspects; and a plurality of magnets extending in a first direction and in a second direction intersecting the first direction with adjacent magnets having mutually different magnetic polarities Next, operation of the flat-type acoustic transducer of the seventh aspect is described.

According to the diaphragm for a flat-type acoustic transducer, the conductor is provided extending in a direction which intersects magnetic force lines between mutually adjacent north poles and south poles. Therefore, when current is passed through the conductor, a direction in which the magnetic field acts on the current is substantially orthogonal to the diaphragm surface. Accordingly, the diaphragm for the flat-type acoustic transducer can be caused to oscillate in directions orthogonal to the surface of the diaphragm main body.

DESCRIPTION OF THE PREFERRED EMBODIMENTS

Embodiments of the Invention

First Embodiment

Below, a first embodiment of a flat speaker, which is a flat-type acoustic transducer, will be explained in detail with reference to the drawings.

Figure 1:
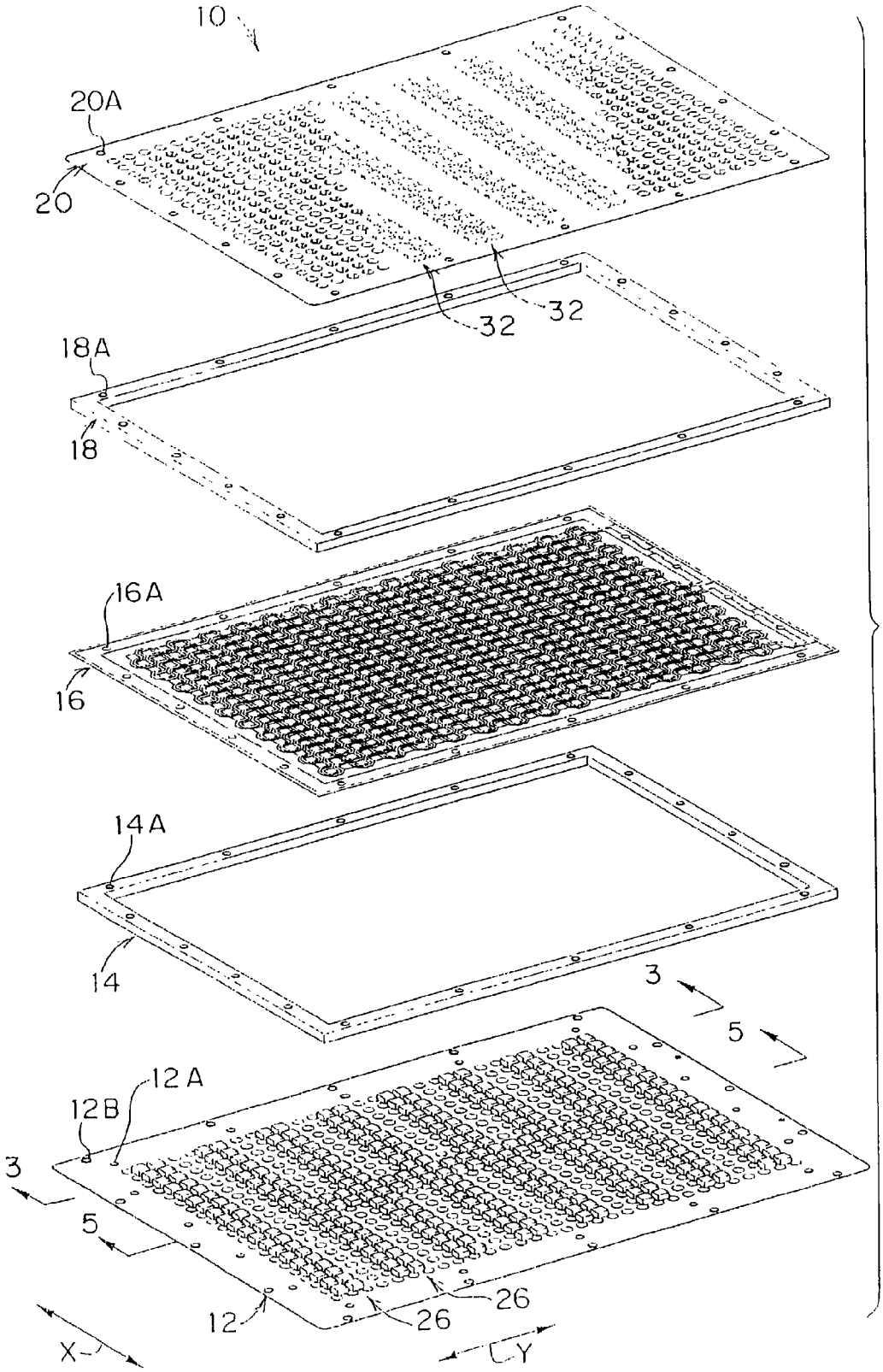
FIG. 1 is an exploded perspective view of a flat speaker relating to a first embodiment of the present invention.

As shown in FIG. 1, a flat speaker 10 of the present embodiment is provided with a first yoke 12, a spacer 14, a diaphragm 16, a spacer 18, and a second yoke 20, which are arranged in this order.

Figure 2:
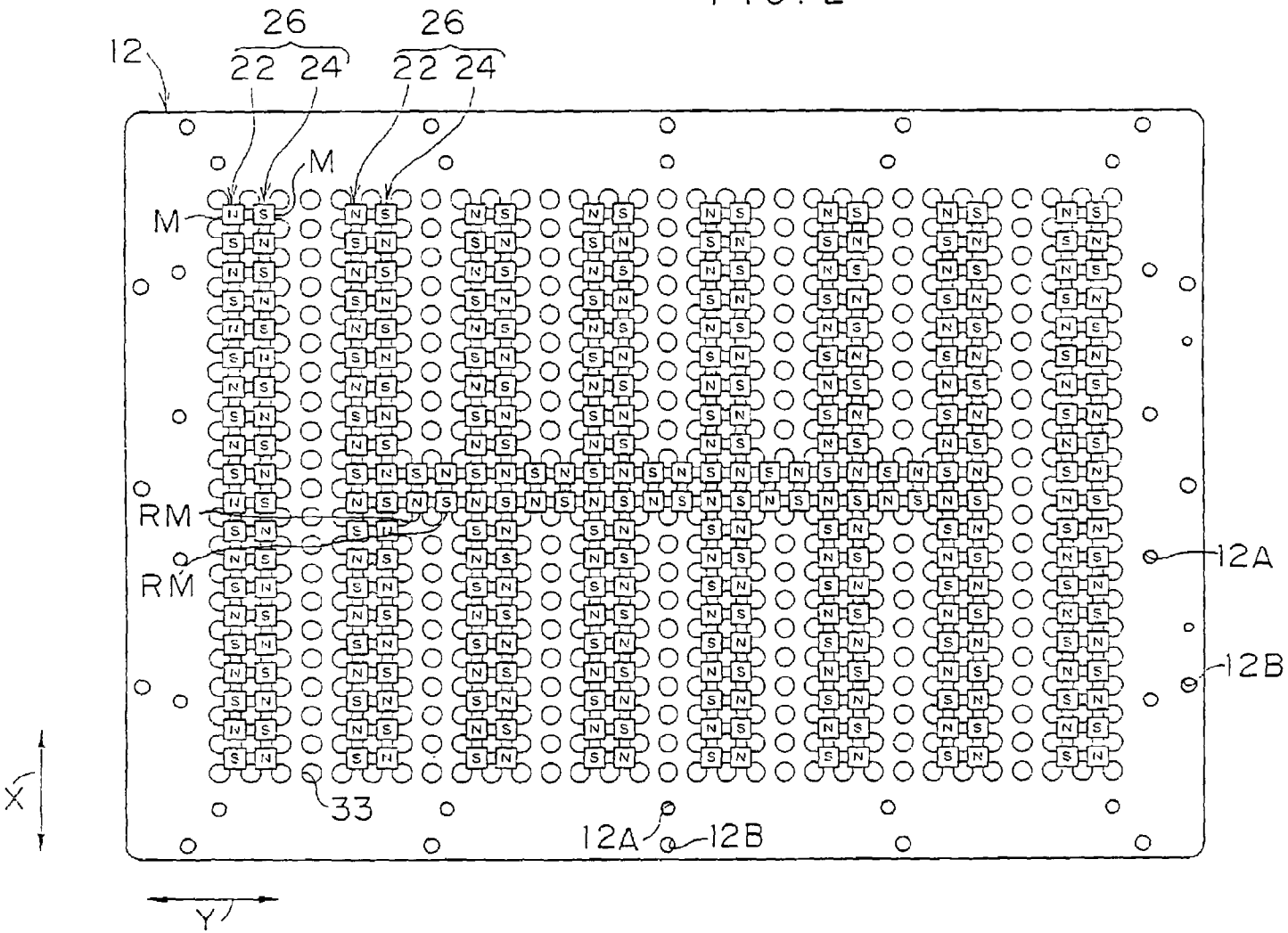
FIG. 2 is a plan view of a first yoke.

As shown in FIG. 2, the first yoke 12 is formed with magnetic bodies, and is formed in a flat board shape which is rectangular with a long side in the Y direction of the drawing.

Figure 3:
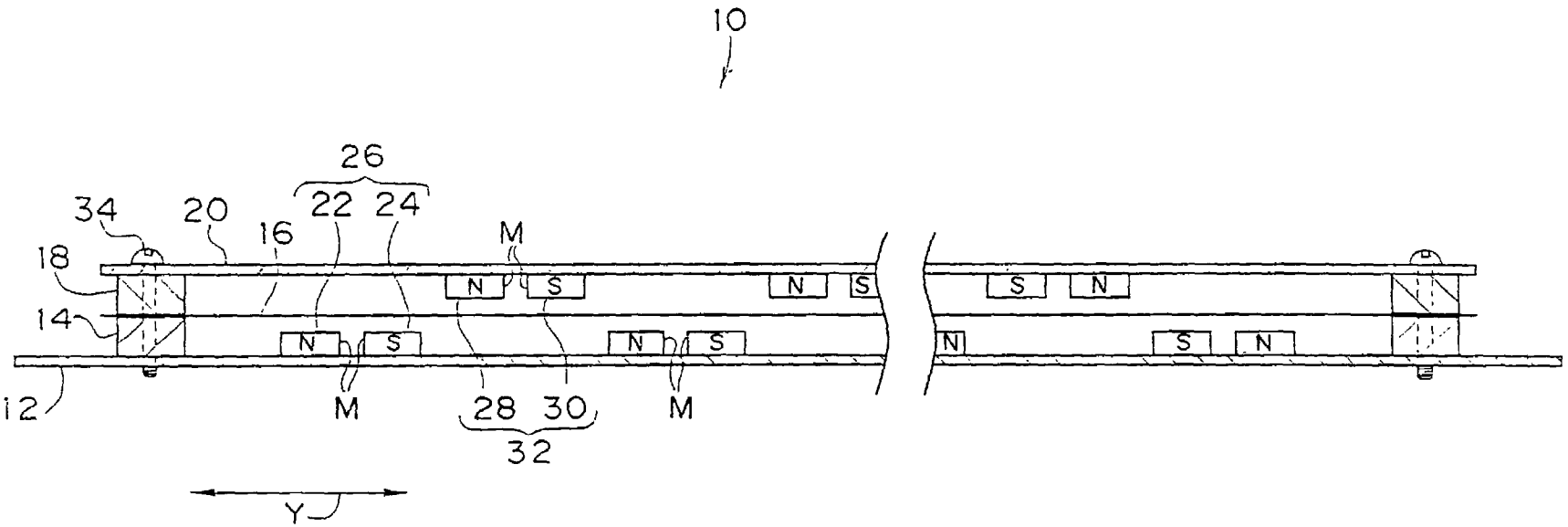
FIG. 3 is a sectional view taken along a line 3—3 of the flat speaker shown in FIG. 1.

As shown in FIGS. 2 and 3, first magnet groups 26 are provided in a plurality of rows (eight rows in the present embodiment), which are separated by a certain interval in the Y direction, at a diaphragm side surface of the first yoke 12. The first magnet groups 26 are formed of two rows of magnets, a first magnet row 22 and a second magnet row 24. At each row, quadrilateral permanent magnets M whose south poles face a diaphragm side and permanent magnets M whose north poles face the diaphragm side are disposed alternately along the X direction, which intersects the Y direction, with a certain spacing.

As shown in FIG. 2, the polarity (shown as S or N in the drawings) of a diaphragm side magnetic pole face of a permanent magnet M of the first magnet row 22 is different from the polarity of a diaphragm side magnetic pole face of the permanent magnet M of the second magnet row 24 that is adjacent to this magnet M of the first magnet row 22.

Figure 4:
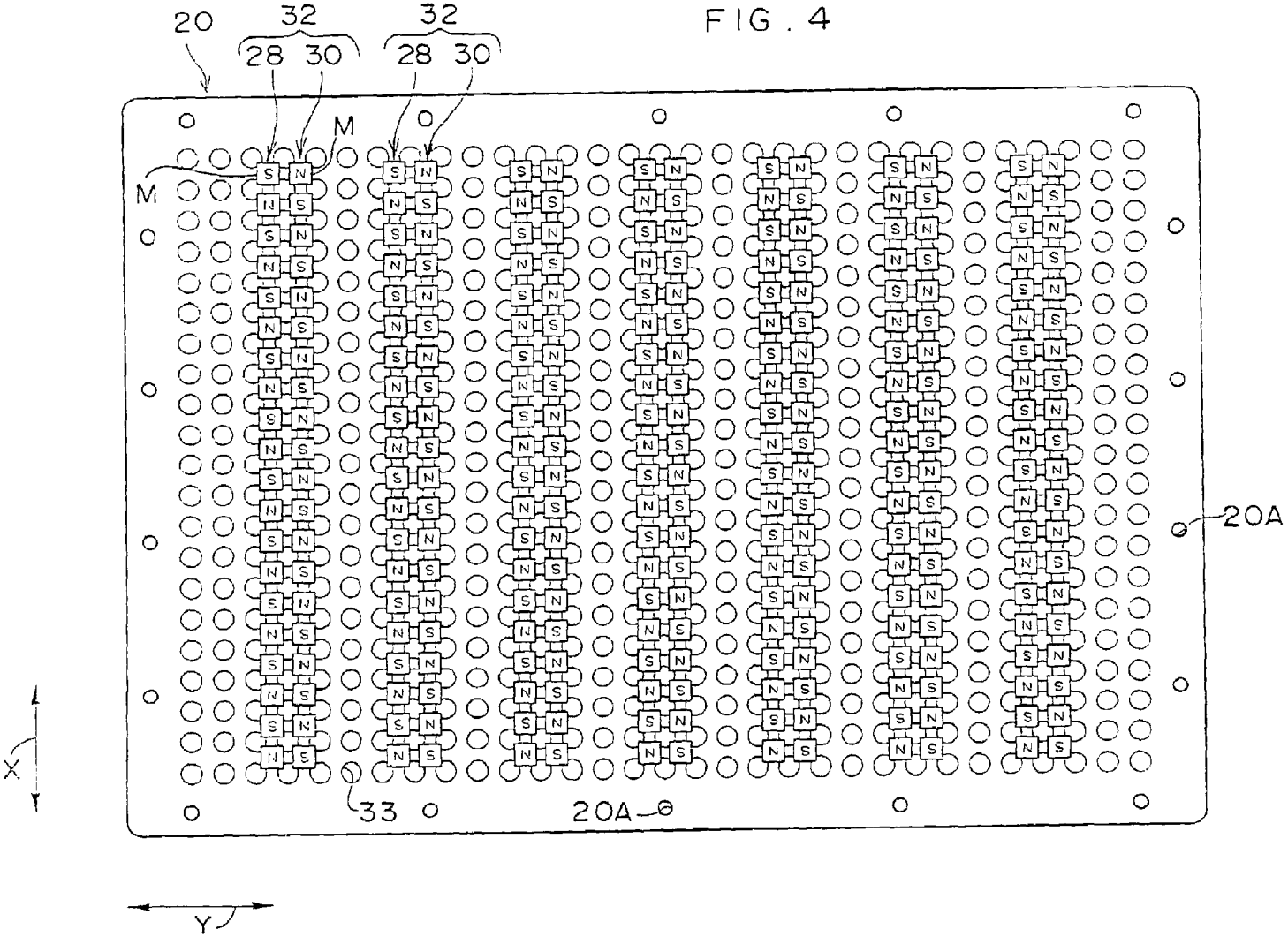
FIG. 4 is a plan view of a second yoke.

As shown in FIG. 4, the second yoke 20 is formed with magnetic bodies, and is formed in a flat board shape which is rectangular with a long side in the Y direction of the drawing.

As shown in FIGS. 3 and 4, second magnet groups 32 are provided in a plurality of rows (seven rows in the present embodiment), which are separated by a certain interval in the Y direction, at a diaphragm side surface of the second yoke 20. The second magnet groups 32 are formed of two rows of magnets, a third magnet row 28 and a fourth magnet row 30. At each row, quadrilateral permanent magnets M whose south poles face a diaphragm side and permanent magnets M whose north poles face the diaphragm side are disposed alternately along the X direction, which intersects the Y direction, with a certain spacing.

As shown in FIG. 4, the polarity (shown as S or N in the drawing) of a diaphragm side magnetic pole face of a permanent magnet M of the third magnet row 28 is different from the polarity of a diaphragm side magnetic pole face of the permanent magnet M of the fourth magnet row 30 that is adjacent to this magnet M of the third magnet row 28.

As shown in FIG. 3, the second magnet groups 32 and the first magnet groups 26 are disposed with a certain spacing in the Y direction. The polarity of a diaphragm side magnetic pole face of a permanent magnet M of the first magnet groups 26 is different from the polarity of a diaphragm side magnetic pole face of the permanent magnet M of the second magnet groups 32 that is adjacent to this magnet M of the first magnet groups 26.

In addition, the magnetic pole faces of the permanent magnets of the first magnet groups 26 face portions of the second yoke 20 at which the permanent magnets M are not disposed, and the magnetic pole faces of the permanent magnets of the second magnet groups 32 face portions of the first yoke 12 at which the permanent magnets M are not disposed.

The permanent magnets M of the first magnet groups 26 and the permanent magnets M of the second magnet groups 32 are distributed such that intervals in the Y direction and the X direction are respectively equal.

Figure 5:
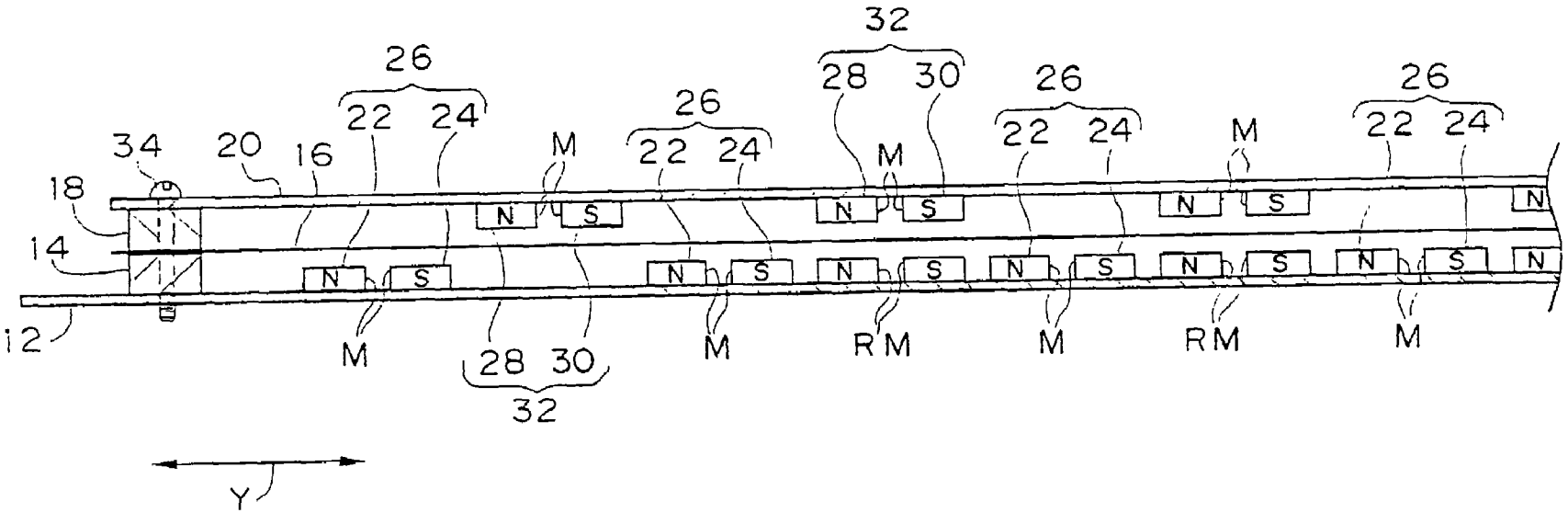
FIG. 5 is a sectional view taken along a line 5—5 of the flat speaker shown in FIG. 1.

As shown in FIGS. 2 and 5, quadrilateral permanent magnets for repulsion RM, whose magnetic pole faces face toward a diaphragm side, are disposed in groups of four at a central vicinity of a diaphragm side surface of the first yoke 12, between the first magnet groups 26.

The repelling permanent magnets RM are disposed at positions facing the permanent magnets M of the second yoke 20. The diaphragm side polarities of the repelling permanent magnets RM are set to be the same as the polarities of the permanent magnets M of the second yoke 20 that face thereto. Thus, the repelling permanent magnets RM and the permanent magnets M of the second yoke 20 facing thereto mutually repel each other.

As shown in FIGS. 2 and 4, large numbers of holes 33 are formed in matrix patterns at the first yoke 12 and the second yoke 20.

As shown in FIGS. 1, 3 and 5, the flat-form diaphragm 16 is arranged between the first yoke 12 and the second yoke 20, with the spacer 14 and the spacer 18 between the diaphragm 16 and, respectively, the first yoke 12 and the second yoke 20.

The spacer 14 and the spacer 18 each have a rectangular frame shape. An outer peripheral vicinity of the diaphragm 16 is sandwiched by the spacer 14 and the spacer 18.

As shown in FIGS. 1, 2,4 and 6, pluralities of screw holes 12A and holes 12B are formed along an outer periphery of the first yoke 12. A plurality of holes 14A are formed along an outer periphery of the spacer 14. A plurality of holes 16A are formed along an outer periphery of the diaphragm 16. A plurality of holes 18A are formed along an outer periphery of the spacer 18. A plurality of holes 20A are formed along an outer periphery of the second yoke 20.

As shown in FIGS. 3 and 5, the second yoke 20, the spacer 18, the diaphragm 16, the spacer 14 and the first yoke 12 are integrally fixed by inserting screws 34 through the holes 20A, the holes 18A, the holes 16A and the holes 14A (these holes are not shown in FIGS. 3 and 5) and screwing the screws 34 into the screw holes 12A.

The holes 12B of the first yoke 12 are used for installation.

The diaphragm 16 is spaced a certain distance apart from the permanent magnets M and the repelling permanent magnets RM by the spacer 14 and the spacer 18.

The diaphragm 16 is structured of a polymer film or the like, such as polyimide, polyethylene terephthalate or the like.

An effective diaphragm area of the diaphragm 16 of the present embodiment is approximately 200 mm×approximately 300 mm.

Figure 6:
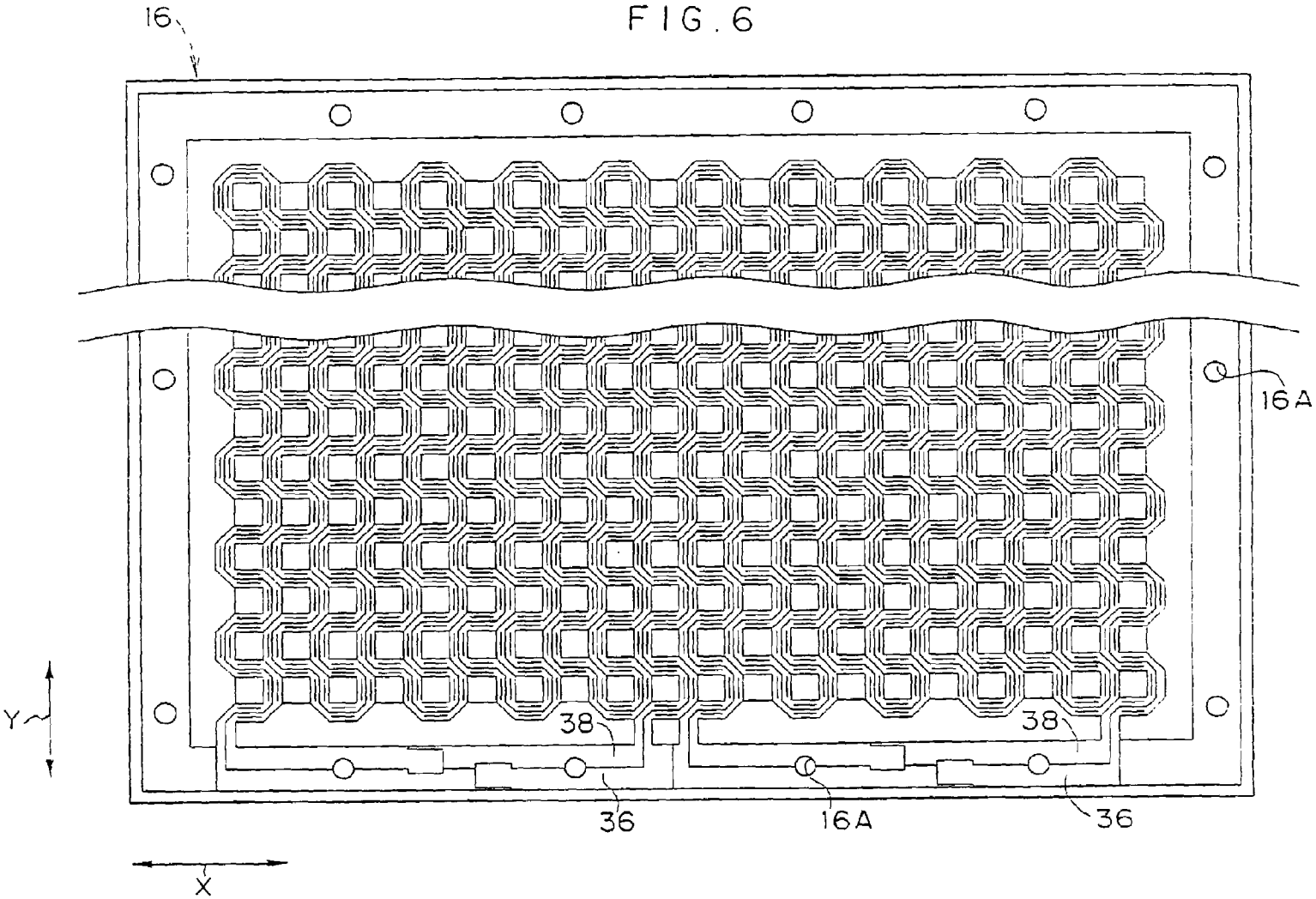
FIG. 6 is a plan view of a diaphragm.

As shown in FIG. 6, first conductors 36 and second conductors 38 are provided at one side of the diaphragm 16. The first conductors 36 and second conductors 38 are provided at regions which sandwich a central portion in the X direction from both sides of the central portion.

Figure 7:
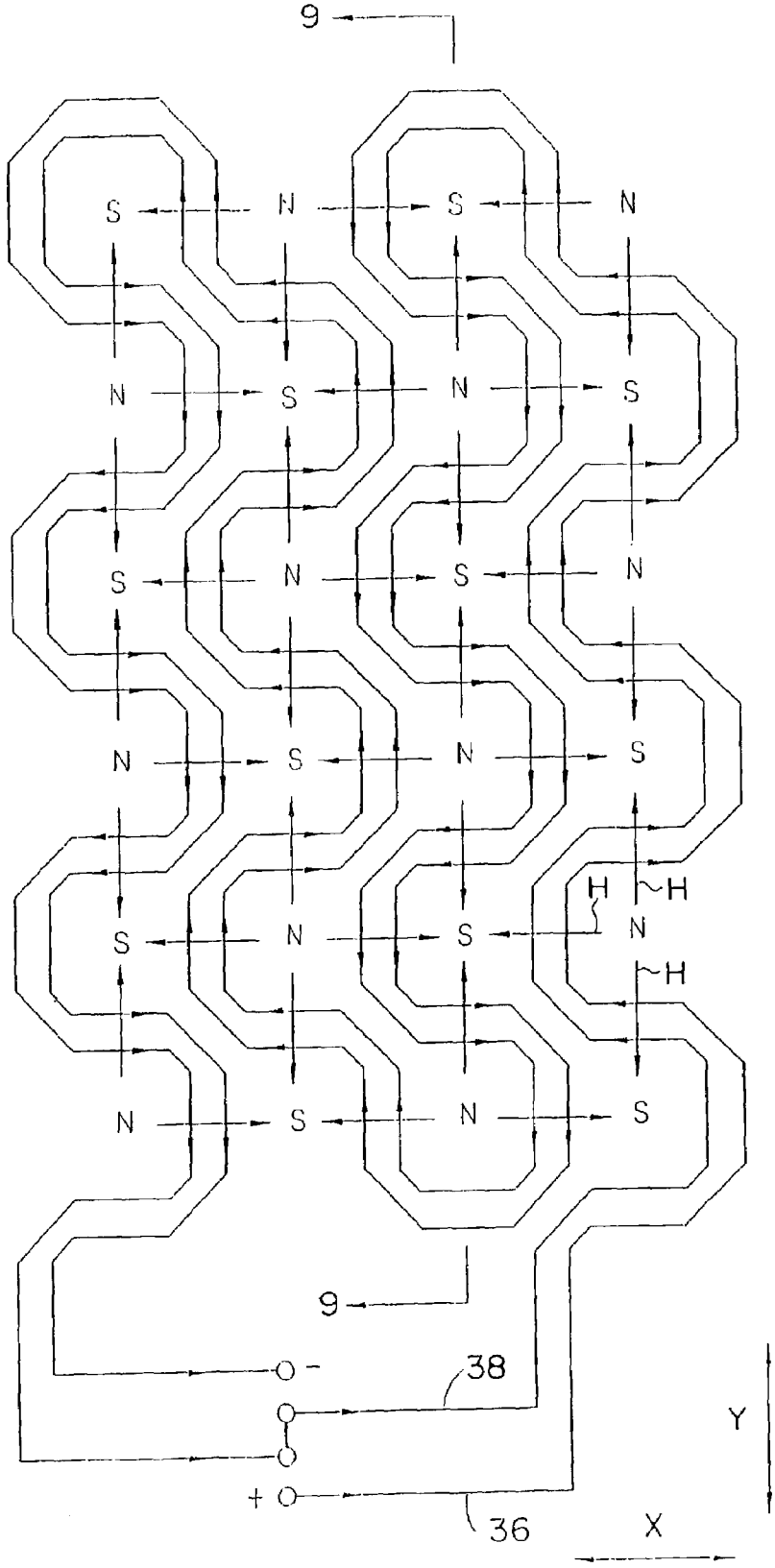
FIG. 7 is a schematic view of a first conductor and a second conductor.

FIG. 7 schematically shows the pattern of the first conductors 36 and the second conductors 38.

Figure 8:
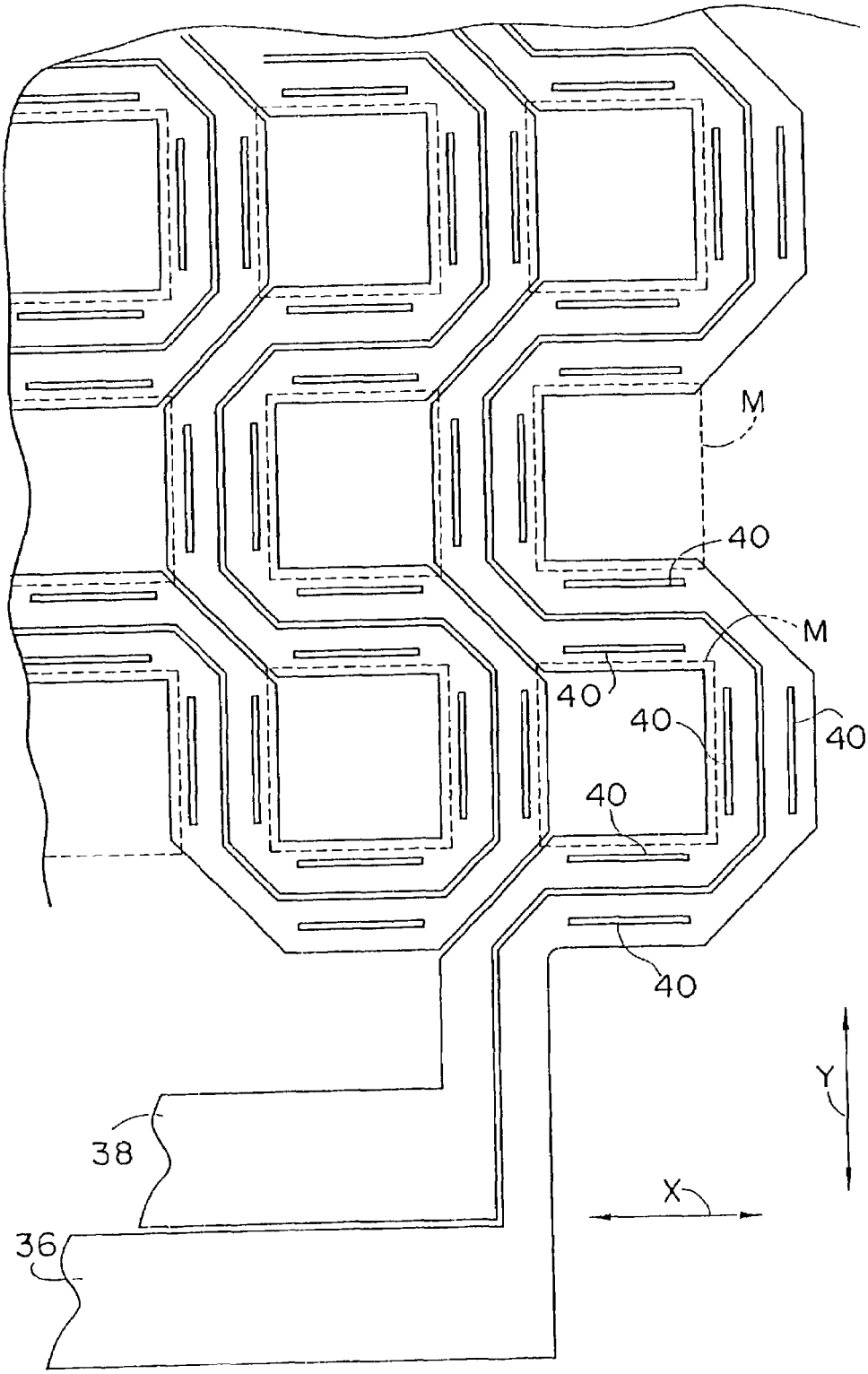
FIG. 8 is a partial enlarged view of the first conductor and the second conductor.

As shown in FIGS. 7 and 8, the first conductors 36 and the second conductors 38 are parallel with each other. As shown in FIG. 8, the first conductors 36 and the second conductors 38 are disposed at an outer peripheral vicinity of all the permanent magnets M and in between the permanent magnets M. The first conductors 36 and the second conductors 38 extend in a zigzag (serpentine or meandering) manner along a lengthwise direction of the magnet rows (the direction of the arrow Y) from one end side in the Y direction to the other end side.

Figure 9:
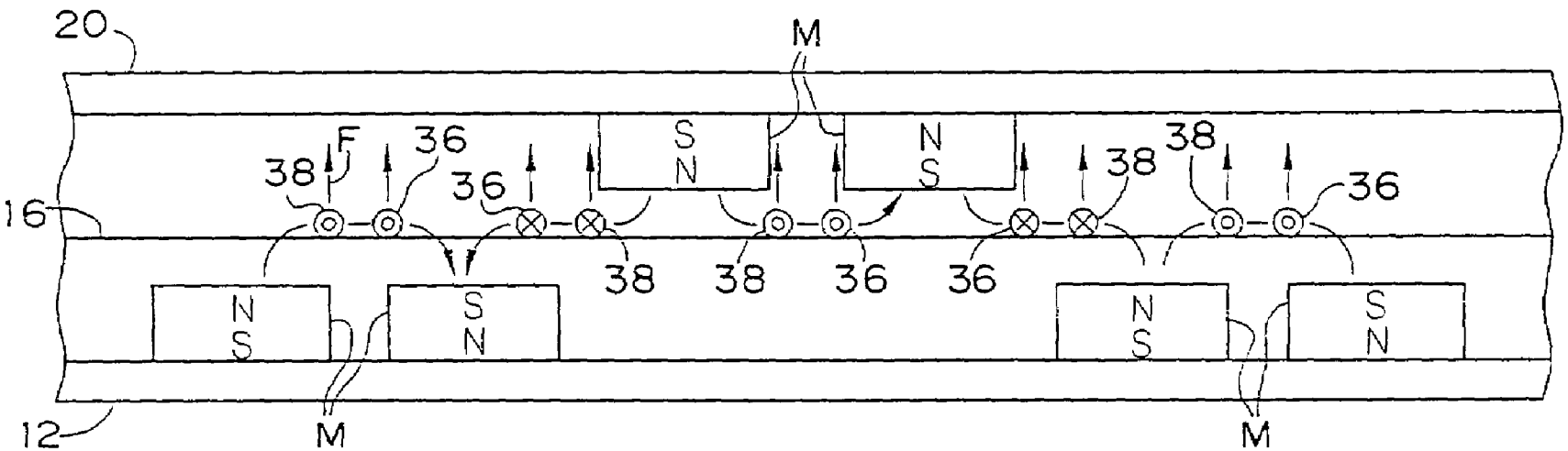
FIG. 9 is a schematic view of a cross-section of part of the flat speaker.

As shown in FIGS. 7 and 9, the first conductors 36 and the second conductors 38 are connected such that current flows in the same direction therealong.

As shown in FIG. 7, the first conductors 36 and second conductors 38 may be connected in series and may be connected in parallel.

These first conductors 36 and second conductors 38 can be formed by laminating, depositing, adhering or the like a metallic film of copper, aluminium or the like onto the diaphragm 16. This metallic film can be structured by etching.

As shown in FIG. 8, the first conductors 36 and the second conductors 38 include wide portions that extend in a straight line along the direction of the arrow X, and wide portions that extend in a straight line along the direction of the arrow Y. At width direction central portions of each of these wide portions, a long, narrow region 40 is provided along the direction of extending of the conductor (a direction which intersects the orientation of a magnetic field), at which region 40 the metallic film is not provided. The long, narrow region 40 divides the conductor into two parallel portions. After region 40 the conductor is rejoined as shown in FIG 8.

Consequently, the occurrence of eddy currents when high frequency currents flow can be suppressed. The conductor may also be divided into three or more portions.

The wide portions of the first conductors 36 and the second conductors 38 that extend in a straight line along the direction of the arrow X and the wide portions of the first conductors 36 and the second conductors 38 that extend in a straight line along the direction of the arrow Y are each substantially parallel to edges of the permanent magnets M.

Furthermore, the wide portions that extend in a straight line along the direction of the arrow X and the wide portions that extend in a straight line along the direction of the arrow Y are connected with minimal separations therebetween.

A width of the pattern of each of the first conductors 36 and a width of the pattern of each of the second conductors 38 are preferably set to at least 500 $\mu$m.

In the present embodiment, the width of the pattern of the first conductor 36 and the width of the pattern of the second conductor 38 are set to 1000 $\mu$m at narrow portions and 2000 $\mu$m at wide portions.

Operation

Next, operation of the flat speaker 10 of the present embodiment will be described.

As shown in FIGS. 7 and 9, when a current I flows in the first conductors 36 and the second conductors 38 (the direction is shown by arrows), a force F (an electromagnetic force) acts in a direction intersecting the direction of the current I and the direction of a magnetic field H, according to Fleming's left hand rule (in the present case, the direction of the Force F is toward the second yoke 20 side).

When the current I flows in the first conductors 36 and the second conductors 38 in the opposite direction to that in the case of FIGS. 7 and 9, the force F acts to displace toward the yoke 12 side.

Therefore, by passing electric signals that represent sounds which are desired to be generated, the diaphragm 16 provided with the first conductors 36 and second conductors 38 oscillates in accordance with the electric signals that are passed.

Sounds that are generated at the diaphragm 16 pass through the holes 33 formed in the first yoke 12 and the second yoke 20 and are radiated to outer sides of the yokes.

Because the diaphragm 16 has a flat shape and oscillates in the direction orthogonal to the membrane surfaces, the sounds radiated from the diaphragm 16 are plane waves.

Further, in the present embodiment, the polarities of neighboring permanent magnets M at the first yoke 12 and the second yoke 20 are set to be different from one another. Thus, the number of N poles at the yoke side and the number of S poles at the yoke side are the same. Thus, flux leakage can be reduced. As a result, it is not necessary to provide a separate magnetic shield.

Here, the permanent magnets M of the first yoke 12 face positions of the second yoke 20 at which permanent magnets M are not disposed, and the permanent magnets of the second yoke 20 face positions of the first yoke 12 at which permanent magnets M are not disposed. Therefore, although the permanent magnets M of the first yoke 12 attract the second yoke 20 and the permanent magnets M of the second yoke 20 attract the first yoke 12, thus acting to curve the first yoke 12 and the second yoke 20, the repelling permanent magnets RM provided at the central vicinity of the first yoke 12 face the permanent magnets M of the second yoke 20, and generate a repulsive force which acts in the opposite direction to the attractive forces. Thus, curvature of the first yoke 12 and the second yoke 20 can be suppressed.

As a result, in the flat speaker 10 of the present embodiment, the areas of the first yoke 12, the second yoke 20, and the diaphragm 16 can be made larger than in conventional products. Accordingly, output can be greater.

Further, as the area of the diaphragm 16 is larger, a low-range reproduction limit can be made lower.

Figure 10:
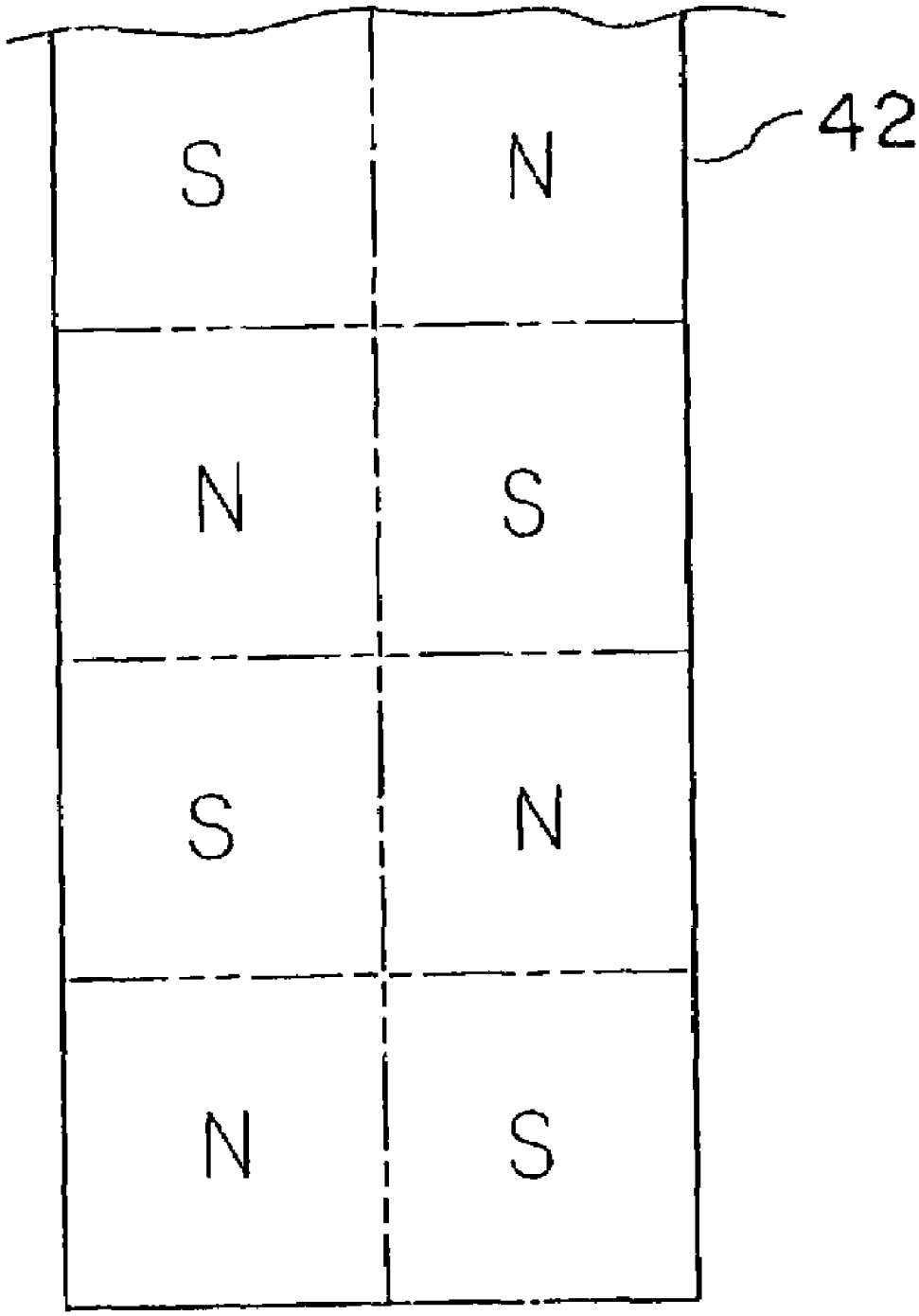
FIG. 10 is a plan view of permanent magnets of a flat speaker relating to another embodiment.

In the present embodiment, the first magnet groups 26 and the second magnet groups 32 are structured with pluralities of permanent magnets M arranged at predetermined intervals. However, the first magnet groups 26 and the second magnet groups 32 each may, as shown in FIG. 10, be a single long permanent magnet 42 which is magnetized with S poles and N poles in a staggered pattern.

Furthermore, the repelling permanent magnets RM are provided at the first yoke 12 in the present embodiment. However, the repelling permanent magnets RM may be provided at the second yoke 20, or may be distributed between both of the first yoke 12 and the second yoke 20.

Moreover, two each of the first conductor 36 and the second conductor 38 are provided at the diaphragm 16 in the present embodiment. Therefore, by connecting these conductors in series or in parallel, the impedance of the flat speaker 10, as a unit, may be changed to various levels.

The widths of the patterns of the first conductors 36 and the widths of the patterns of the second conductors 38 are each set to 1000 $\mu$m at narrow portions and 2000 $\mu$m at wide portions, which dimensions are relatively wide.

Consequently, the effect of variations in the width of the patterns due to etching (for example, ±20 $\mu$m) is, proportionally, extremely small. Thus, variations in direct current resistance can be made small, and the problem of localized heating will not occur.

Further, because the first conductors 36 and the second conductors 38 are provided at one side of the diaphragm 16, the structure is simple and fabrication is easy.

In addition, the flat speaker 10 of the present embodiment could be used as a microphone.

Second Embodiment

Next, a flat speaker 50 relating to a second embodiment of the present invention will be described.

Figure 11:
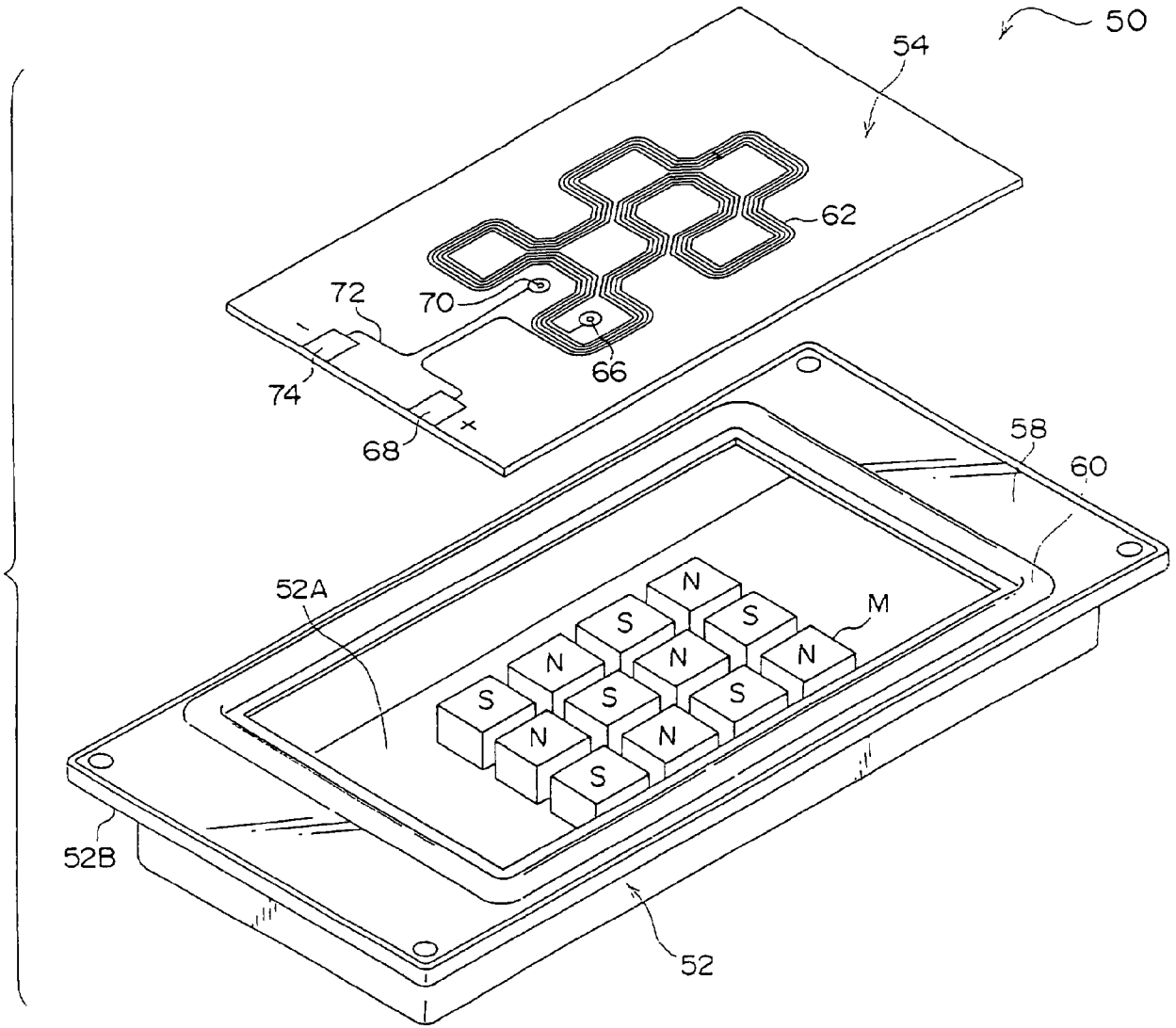
FIG. 11 is an exploded perspective view of a flat speaker relating to a second embodiment.
Figure 12:
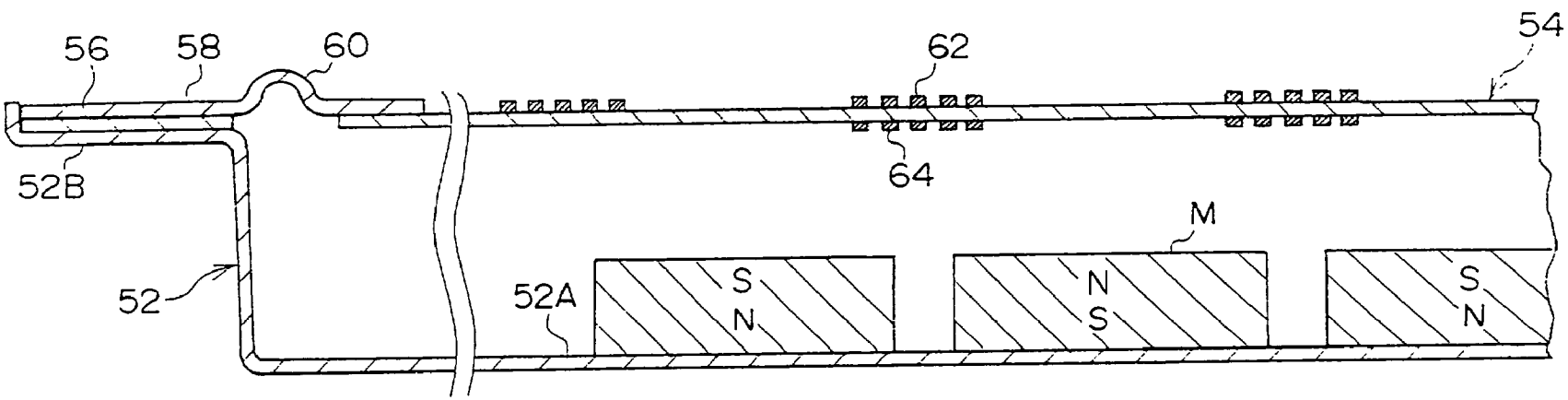
FIG. 12 is a sectional view of the flat speaker relating to the second embodiment.

As shown in FIGS. 11 and 12, the flat speaker 50 is provided with a yoke 52, which includes a plate-like member formed with magnetic bodies.

Twelve permanent magnets M are fixedly arranged at a magnet fixed portion 52A of the yoke 52 by glueing. The permanent magnets M are formed with substantially flat, quadrilateral shapes. The permanent magnets M are magnetized such that magnet faces with different polarities are mutually adjacently positioned, and are provided at predetermined spacings.

A diaphragm 54 is disposed near the magnet faces of the permanent magnets M at an upper face side of the yoke 52. The diaphragm 54 is substantially parallel with the magnet faces, and therefore with an upper face of the yoke 52.

An outer peripheral vicinity of a substantially rectangular frame body 58 is fixed at a diaphragm attachment portion 52B of the yoke 52, with a spacer 56 interposed therebetween.

An edge 60 is formed continuously along an outer periphery at the frame body 58. The edge 60 is a resilient portion with a substantially semi-circular arc-shaped cross-section.

An outer peripheral vicinity of the diaphragm 54 is adhered at an inner periphery side of the frame body 58.

Figure 13A:
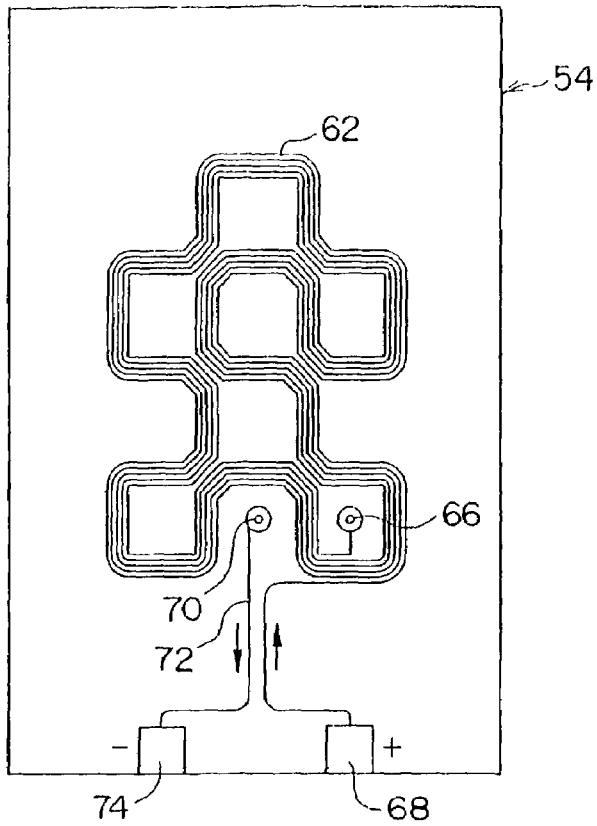
FIG. 13A is a plan view of a front side of a diaphragm of the flat speaker relating to the second embodiment.
Figure 13B:
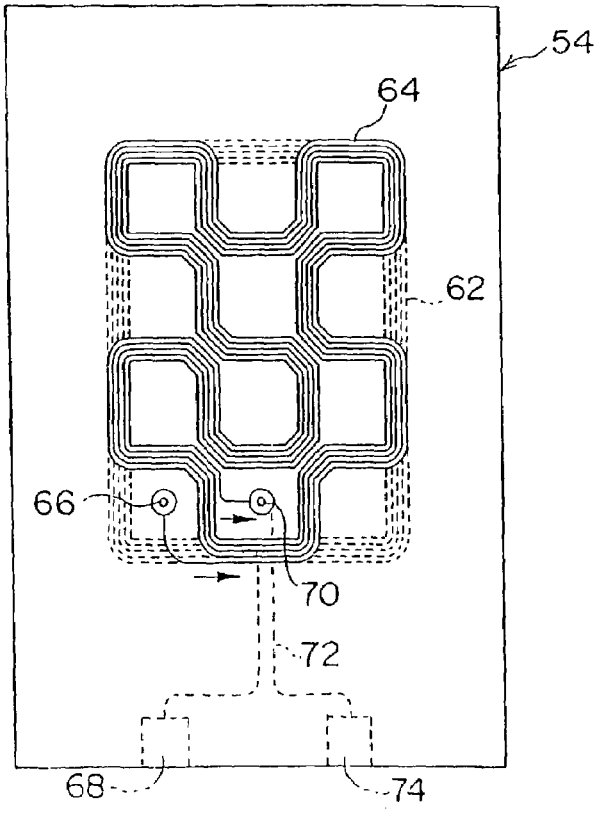
FIG. 13B is a plan view of a rear side of the diaphragm of the flat speaker relating to the second embodiment.

A front face side conductor 62 is formed at a front face of the diaphragm 54, as shown in FIG. 13A, and a rear face side conductor 64 is formed at a rear face of the diaphragm 54, as shown in FIG. 13B.

One end of the front face side conductor 62 is connected at a through-hole 66, and another end is connected at a positive side connection terminal portion 68.

Now, the rear face side conductor 64 has the same pattern as the front face side conductor 62, and is disposed at the opposite side from the front face side conductor 62 (see FIG. 12).

One end of the rear face side conductor 64 is connected to the front face side conductor 62 via the through-hole 66. Another end of the rear face side conductor 64 is connected to a negative side connection terminal portion 74 on the front face side via a through-hole 70 and a lead portion 72 at the front face side.

Thus, the front face side conductor 62 and the rear face side conductor 64 are connected in series in the present embodiment. The front face side conductor 62 and the rear face side conductor 64 are connected such that, viewed from one side of the diaphragm 54, current flows in the same direction in the front face side conductor 62 and the rear face side conductor 64 (the direction of a current is shown by arrows in the drawings).

As shown in FIG. 11 and FIG. 12, the front face side conductor 62 and the rear face side conductor 64 are plurally wound at outer peripheral vicinities of the respective permanent magnets M, and are disposed at positions sandwiched by the outer peripheral vicinities of the respective permanent magnets M (positions outward and inward of the outer peripheries of the permanent magnets M if the diaphragm 54 is regarded in plan view).

The front face side conductor 62 and the rear face side conductor 64 may be disposed so as to at least intersect a magnetic field. Regarding the diaphragm 54 in plan view, the front face side conductor 62 and the rear face side conductor 64 may be disposed such that portions thereof that are nearest the permanent magnets M substantially correspond to the outer peripheries of the permanent magnets M, and need not be disposed inward of the outer peripheries of the permanent magnets M.

In consideration of etching errors, widths of the front face side conductor 62 and the rear face side conductor 64 are preferably at least 200 $\mu$m. In the present embodiment, the widths of the front face side conductor 62 and the rear face side conductor 64 are set to 250 $\mu$m.

When current is passed through the front face side conductor 62 and the rear face side conductor 64 in the present embodiment, force acts in a direction orthogonal to a membrane surface of the diaphragm 54, and the diaphragm 54 is displaced in the direction orthogonal to the membrane surface.

Because the conductors are provided at both sides of the diaphragm 54 in the present embodiment, a driving force substantially twice that in a case in which conductors are provided at only one side can be obtained. Thus, efficiency can be improved. Furthermore, because all of the outer peripheries of the permanent magnets M are encircled by at least one of the front face side conductor 62 and the rear face side conductor 64 in the present embodiment, driving force can be applied consistently over the diaphragm 54.

Although the front face side conductor 62 and the rear face side conductor 64 are connected in series in the present embodiment, they could be connected in parallel if appropriate.

Further, a plurality of the diaphragm 54 may be superposed, fixed and utilized. In such a case, the conductors of the respective diaphragms 54 may be connected via through-holes.

In the present embodiment, the front face side conductor 62 and the rear face side conductor 64 are connected via a through-hole. However, the through-hole may be omitted and the front face side conductor 62 and rear face side conductor 64 connected with lead wiring or the like.

Third Embodiment

Next, a flat speaker 80 relating to a third embodiment of the present invention will be explained. The flat speaker 80 of the present embodiment is a variant example of the flat speaker 50 of the second embodiment.

Figure 14:
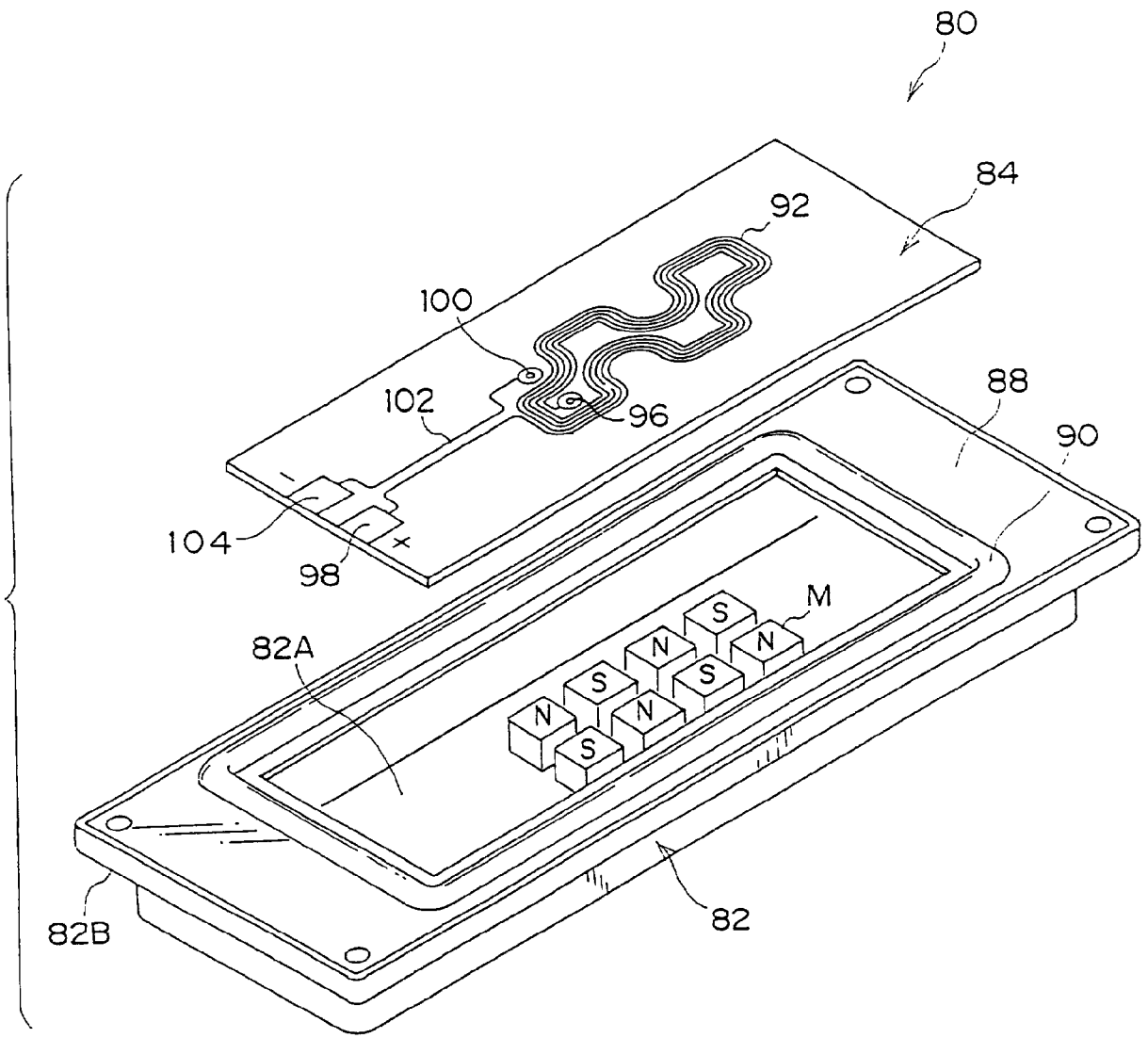
FIG. 14 is an exploded perspective view of a flat speaker relating to a third embodiment.

As shown in FIG. 14, eight permanent magnets M are fixedly arranged at a magnet fixed portion 82A of a yoke 82. The permanent magnets M are magnetized such that magnet faces with different polarities are mutually adjacently positioned, and are provided at predetermined spacings.

A diaphragm 84 is disposed near the magnet faces at an upper face side of the yoke 82.

An outer peripheral vicinity of a substantially rectangular frame body 88 is fixed at a diaphragm attachment portion 82B of the yoke 82, with an unillustrated spacer interposed therebetween.

An edge 90 is formed continuously along an outer periphery at the frame body 88. The edge 90 is a resilient portion with a substantially semi-circular arc-shaped cross-section.

An outer peripheral vicinity of the diaphragm 84 is adhered at an inner periphery side of the frame body 88.

Figure 15A:
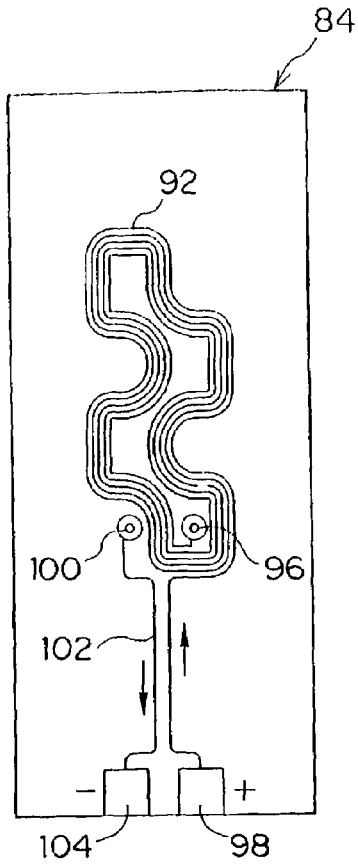
FIG. 15A is a plan view of a front side of a diaphragm of the flat speaker relating to the third embodiment.
Figure 15B:
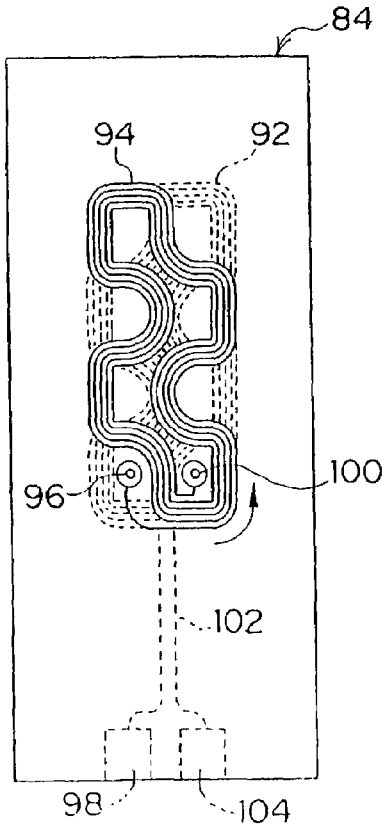
FIG. 15B is a plan view of a rear side of the diaphragm of the flat speaker relating to the third embodiment.

A front face side conductor 92 is formed at a front face of the diaphragm 84, as shown in FIG. 15A, and a rear face side conductor 94 is formed at a rear face of the diaphragm 84, as shown in FIG. 15B.

One end of the front face side conductor 92 is connected at a through-hole 96, and another end is connected at a positive side connection terminal portion 98.

Now, the rear face side conductor 94 has the same pattern as the front face side conductor 92, and is disposed at the opposite side from the front face side conductor 92.

One end of the rear face side conductor 94 is connected to the front face side conductor 92 via the through-hole 96. Another end of the rear face side conductor 94 is connected to a negative side connection terminal portion 104 on the front face side via a through-hole 100 and a lead portion 102 at the front face side.

Thus, the front face side conductor 92 and the rear face side conductor 94 are connected in series in the present embodiment. The front face side conductor 92 and the rear face side conductor 94 are connected such that, viewed from one side of the diaphragm 84, current flows in the same direction in the front face side conductor 92 and the rear face side conductor 94 (the direction of a current is shown by arrows in the drawings).

As in the second embodiment, the front face side conductor 92 and the rear face side conductor 94 are plurally wound at outer peripheral vicinities of the respective permanent magnets M, and are disposed at positions sandwiched by the outer peripheral vicinities of the respective permanent magnets M (positions outward and inward of the outer peripheries of the permanent magnets M if the diaphragm 84 is regarded in plan view). The front face side conductor 92 and the rear face side conductor 94 may be disposed so as to at least intersect a magnetic field. Regarding the diaphragm 84 in plan view, the front face side conductor 92 and the rear face side conductor 94 may be disposed such that portions thereof that are nearest the permanent magnets M substantially correspond to the outer peripheries of the permanent magnets M, and need not be disposed inward of the outer peripheries of the permanent magnets M.

In consideration of etching errors, widths of the front face side conductor 92 and the rear face side conductor 94 are preferably at least 200 $\mu$m. In the present embodiment, the widths of the front face side conductor 92 and the rear face side conductor 94 are set to 250 $\mu$m.

When current is passed through the front face side conductor 92 and the rear face side conductor 94 in the present embodiment, force acts in a direction orthogonal to a membrane surface of the diaphragm 84, and the diaphragm 84 is displaced in the direction orthogonal to the membrane surface.

Because the conductors are provided at both sides of the diaphragm 84 in the present embodiment, a driving force substantially twice that in a case in which conductors are provided at only one side can be obtained. Thus, efficiency can be improved. Furthermore, because all of the outer peripheries of the permanent magnets M are encircled by at least one of the front face side conductor 92 and the rear face side conductor 94 in the present embodiment, driving force can be applied consistently over the diaphragm 84.

What is claimed is:

1. A diaphragm for use in a flat-type acoustic transducer having a plurality of magnets extending in a first direction and in a second direction intersecting the first direction with adjacent magnets having mutually different magnetic polarities, the diaphragm comprising:

a flat-form diaphragm main body mountable facing the magnets; and a conductor provided at the diaphragm main body intersecting a magnetic field formed between north poles and south poles of adjacent magnets, and the conductor being disposed around a circumference of each magnet by less than 360° and wherein the conductor includes a section at which the conductor is divided into a plurality of parallel conductor portions and the divided portions are subsequently rejoined in order to reduce eddy currents.

2. The diaphragm of claim 1, wherein the magnets are arranged in at least one of a row along the first direction and the second direction, and the conductor comprises a zigzag portion which extends in a zigzag fashion along said row.

3. The diaphragm of claim 1, wherein a plurality of the conductors are provided, with each respective conductor being insulated and arranged parallel and proximate one another in a width direction thereof.

4. The diaphragm of claim 1, wherein the conductor comprises a provided at at least one face of the diaphragm main body.

5. The diaphragm of claim 4, wherein the plurality of magnets is disposed at both sides of diaphragm for a flat-type acoustic transducer, and the conductor is provided at one face of the diaphragm main body.

6. The diaphragm of claim 4, wherein the plurality of magnet is disposed at one side of the diaphragm for a flat-type acoustic transducer, and the conductor is provided at both faces of the diaphragm main body.

7. A flat-type acoustic transducer comprising:

the diaphragm for a flat-type acoustic transducer of claim 1; and a plurality of magnets extending in a first direction and in a second direction intersecting the first direction with adjacent magnets having mutually different magnetic polarities.

8. A flat-type diaphragm comprising:

a flat-form diaphragm main body; and a conductor provided at a surface of the diaphragm main body, the conductor being disposed around a circumference of each of a plurality of specified regions of the surface by less than 360° and wherein the conductor includes a section at which the conductor is divided into a plurality of parallel conductor portions and the divided portions are subsequently rejoined in order to reduce eddy currents.

9. The flat-type diaphragm of claim 8, wherein the plurality of regions extend in a first direction and in a second direction intersecting the first direction, and the conductor comprises a zigzag portion extending in a zigzag fashion along one of the first direction and the second direction.

10. The flat-type diaphragm of claim 8, wherein a plurality of the conductors are provided, with each conductor being insulated and arranged parallel and proximate one another in a width direction thereof.

11. The flat-type diaphragm of claim 8, wherein the conductor is provided at at least one face of the diaphragm main body.

12. A flat-type acoustic transducer comprising:

the flat-type diaphragm of claim 8; and a plurality of magnets facing the flat-type diaphragm at positions corresponding to the plurality of specified regions, the plurality of magnets being arranged such that diaphragm side faces of adjacent magnets have mutually different magnetic polarities.

13. The flat-type acoustic transducer of claim 12, wherein the plurality of magnets is disposed at both sides of the flat-type diaphragm, and the conductor is provided at one face of the diaphragm main body.

14. The flat-type acoustic transducer of claim 12, wherein the plurality of magnets is disposed at one side of the flat-type diaphragm, and the conductor is provided at both faces of the diaphragm main body.

15. The diaphragm of claim 1 wherein the conductor comprises a width of at least 1000 $\mu$m.

16. The flat-type diaphragm of claim 8 wherein the conductor comprises a width of at least 1000 $\mu$m.

* * * * *